United States Patent [19]

Feffer

[11] 4,309,801

[45] Jan. 12, 1982

[54] TEXTURIZING PROCESS

[75] Inventor: Philip C. Feffer, Silver Spring, Md.

[73] Assignee: Chevron Research, San Francisco, Calif.

[21] Appl. No.: 52,880

[22] Filed: Jun. 28, 1979

[51] Int. Cl.[3] ..... D02G 1/16; D02G 1/12

[52] U.S. Cl. ..... 28/248; 28/221; 28/254

[58] Field of Search ..... 28/221, 248, 254

[56] References Cited

U.S. PATENT DOCUMENTS

| | | | |
|---|---|---|---|
| 3,261,155 | 7/1966 | Kunzle | 28/248 X |
| 3,359,609 | 12/1967 | Iwnicki et al. | 28/221 |
| 3,413,697 | 12/1968 | Agett et al. | 28/221 |
| 3,753,275 | 8/1973 | Stanley | 28/221 |
| 3,879,819 | 4/1975 | Guenther | 28/254 X |
| 4,122,588 | 10/1978 | Borenstein et al. | 28/221 |

*Primary Examiner*—Robert Mackey

*Attorney, Agent, or Firm*—J. A. Buchanan, Jr.; T. G. DeJonghe; L. S. Squires

[57] ABSTRACT

An improved method and apparatus for texturizing thermoplastic yarn. The process and apparatus are characterized by a unique control system which facilitates accumulatorless operation and which allows two or more yarns to be texturized at the same time and wound on the same winder spindle. The control system is adapted to sense relative high and low yarn tension and to control tension to control wound yarn length to ensure that equal lengths of each yarn are collected (wound) on the winder spindle without over tensioning the yarn and without intermediate yarn accumulation.

11 Claims, 8 Drawing Figures

TEXTURIZING PROCESS

BACKGROUND OF THE INVENTION

1. Field of the Invention

This invention relates to an improved method and apparatus for texturizing yarn. In a further aspect, the invention relates to a texturizing process, and apparatus therefor, for simultaneously texturizing two or more yarns and winding said yarns on a single winder roll. In another aspect, this invention relates to an improved texturizing system for texturizing two or more yarns having a unique control-sensing system wherein the relative tensions on said yarns are sensed with respect to an upper value (yarn tightness) and a lower value (yarn slack) and in response thereto to rate of yarn takeup and respective yarn lengths are adjusted to effectuate simultaneous wind-up of two or more yarns of substantially equal length on a single roll. In still another aspect, the invention relates to fluidized crimping and bounce crimp texturizing.

2. The Prior Art

Synthetic thermoplastic yarn materials are produced as a number of continuous, straight, smooth filaments. Such yarns have little bulk, and their utility in textile applications is thus rather limited.

In order to enhance the bulk and texture of synthetic yarns, a variety of crimping processes have been used in the past. One common technique which has been used for thermoplastic yarns is to bend the yarn filaments and heat the yarn while the filaments are in bent or crimped configurations, commonly referred to as false twist texturizing; note, for example, U.S. Pat. Nos. 3,932,986 and 3,946,546. Another type of texturizing is fluidized texturizing such as, for example, described in U.S. Pat. No. 2,869,967 and stuffer box crimping such as, for example, described in U.S. Pat. No. 4,081,886.

One especially good texturizing technique, in terms of yielding a high-bulked yarn, is known as "rebound" or "bounce crimping" such as for example described in U.S. Pat. No. 3,665,567.

It would be very desirable to increase the production of a given yarn processing apparatus by simultaneously processing (e.g., texturizing) two or more yarns. On its face, it would seem that this could be effectuated by merely adding additional texturizing units and then winding all of the processed yarns in discrete packages on a common winder spindle. However, it has been found that the yarns issuing from the respective texturizers are not equal in length thus producing an imbalance which ultimately causes yarn damage and makes an unusable yarn package. One way to obviate this problem would be to use separate winders, but as the winder is one of major components of the yarn processing apparatus, both in terms of cost and size, there would be little advantage to this over simply using an individual yarn processing apparatus for each yarn.

The invention which will be subsequently described, can be especially advantageously applied to bounce crimping. Bounce crimping entails hurling yarn, propelled by a heated fluid through a jet, in a continuous stream-like flow against a foraminous surface upon which the yarn impinges and from which the yarn instantaneously rebounds or bounces. The impact of the yarn upon the foraminous surface axially buckles and crimps individual filaments of the yarn while the heated fluid passes through the foraminous surface. The texturized yarn progresses without tension and substantially by rebound inertia away from the crimping zone and, in the original prior art process, was guided to a collection station where the yarn was heated and then cooled to heat-set the crimp prior to winding upon a storage spool.

Thermoplastic yarn texturized by the foregoing bounce crimping process possesses, inter alia, exceptional covering power.

Although, bounce crimping produces a particularly desirable product, the process has certain sensitivities. Thus, in order to properly conduct bounce crimping, it is important that the yarn is rebounded from the screen and discharged from the bounce crimper under essentially no tension. The yarn cannot be pulled from the bounce crimper, since tension on the yarn at this point could pull the crimp from the yarn and could also cause the foraminous screen to be bypassed.

Various improvements in bounce crimp texturizing processes and apparatus are described in U.S. Pat. Nos. 3,859,696, 3,859,697, 3,879,819 and 3,887,971. All of the apparatus and processes described in these patents and in U.S. Pat. No. 3,665,567 are characterized by the use of a J-tube type yarn accumulator wherein the yarn is accumulated (piled) and heat-treated (heat-set and cooled). In U.S. Pat. No. 3,879,819, the J-tube is provided with a photo-cell light sensing means for maintaining a contain height (pile) of yarn in the J-tube by regulating the yarn wind-up speed in response to the sensing means.

The J-tube accumulator was used by the prior art to heat-set the crimp in the yarn and to ensure that the yarn rebounded from the bounce crimp screen in a tensionless state by permitting the yarn to free-fall into the J-tube accumulator. Subsequently, the J-tube was primarily used only for the second purpose. However, in accumulating or piling the yarn, tangles were found to occur, resulting in localized pulling on the yarn as it was wound up, thus causing the crimp to be pulled out of random segments of the yarn and/or the yarn to break. The frequency of these breaks also necessitates an increase in the number of operators required to operate or monitor a given number of texturizing machines and rethread the yarn when breaks occur.

Also, where low-denier yarns (e.g., about 500 denier or less) are used, the problem is magnified such that accumulator systems cannot be efficiently used. This magnification is believed caused by the fact that the lower the denier, the more loops or coils that are in contact with each other in the accumulator. Hence, the more contact, the more chance there is for filaments of the various loops to tangle with each other. This increased contact, coupled with the lower weight of the loops or coils, substantially increases the likelihood of the loops being pulled out of the accumulator, resulting in increased piling and tangles, etc.

In my copending application, Ser. No. 967,449, filed Dec. 7, 1978, now U.S. Pat. No. 4,226,010, I disclosed a method and apparatus for collecting (winding) the yarn from the bounce crimp texturizer without tensioning the yarn in the critical area and without significantly accumulating (piling) the yarn which substantially eliminated the tangling problems of the prior art processes.

In my copending application U.S. Ser. No. 46,730 filed on June 7, 1979, I disclosed an accumulatorless bounce crimping texturizing process and apparatus using a novel tension-slack sensing and control system.

which also eliminates the afore-discussed tension and yarn tangling problems.

SUMMARY OF THE INVENTION

The present invention provides a method and apparatus for texturizing yarns whereby two or more texturized yarns can be advantageously collected on the same winder spindle thereby greatly increasing production from a given yarn processing unit. Further, the invention can be felicitously applied to bounce crimp texturizer systems to provide a system which ensures that the freshly texturized yarn is discharged from the bounce crimper without intermediate yarn accumulation, thus eliminating the yarn tangling problems discussed above. The present invention accomplishes these results by providing a process and apparatus, incorporating a novel control system, which senses the yarn tension and controls the rate of yarn take-up and selectively controls the length of each yarn to achieve the above-discussed results.

In one embodiment, the invention comprises a process simultaneously texturizing two or more yarns which comprises respectively supplying two or more yarns to individual texturizers and winding the texturized yarns on a single rotating winder spindle, preferably laterally offset from said texturizers, sensing the relative tension or said yarns relative to a predetermined high tension value (e.g. yarn tightness) at a location between said texturizer and said winder spindle and when the sensed relative tension on any yarn exceeds said predetermined high tension value, decreasing the wind-up speed of said winder spindle (i.e., yarn take-up) and increasing the rate of yarn take-up when the sensed tension on every yarn is equal to or less than said predetermined high value; sensing the tension on each of said yarns relative to a predetermined low tension value (e.g. yarn slack) at a position between said texturizer and said spindle and when, and while, the sensed slack on any yarn is less than said predetermined low tension value, applying an amount of tension to the other yarns, whose sensed relative tension is greater than or equal to said predetermined low tension value, to gently pull out loop-to-loop compaction, without pulling out crimp, thereby lengthening said other yarns, thus equalizing yarn length.

In one embodiment, the apparatus of the invention comprises at least two texturizing means for texturizing yarn; a a yarn supply means for each texturizer for respectively supplying a drawn yarn to each texturizing means; a single wind-up spindle means, preferably positioned laterally offset from the texturizing means, for collecting said yarns by winding said yarns on the said wind-up spindle; a high tension sensing means positioned between the texturizer means and said wind-up means for sensing the tension on said yarns relative to a predetermined high tension value, a first control means operatively connected to said tension sensing means and said wind-up means for decreasing the wind-up speed of said yarns when the tension on any yarn sensed by said first tension sensing means exceeds said predetermined high tension value; a low tension sensing means for each yarn positioned between said texturizing means and said wind-up means; for sensing the tension on each of said yarns relative to a predetermined low tension value, a tension means for each yarn for respectively applying tension to each of said yarns at a location between said low tension sensing means and said wind-up spindle; a second control means operatively connected to each low tension means for causing said tension means to selectively apply sufficient tension to the other yarns to increase their length by pulling out yarn compaction without pulling out crimp in response to said low sensed tension whereby when the low sensed tension for any yarn is less than said predetermined low tension value, said tension means asserts tension on the other yarns, whose sensed tension is greater than or equal to said predetermined low tension value, thereby increasing the length of the other yarns.

In a further embodiment of the invention, the texturizers used in the aforedescribed processes and apparatus are bounce crimp texturizers.

BRIEF DESCRIPTION OF THE DRAWING

The drawings represent preferred non-limiting embodiments of the process and apparatus of the invention, wherein like reference numbers refer to like parts, wherein.

FURTHER DESCRIPTION OF THE INVENTION AND PREFERRED EMBODIMENTS

Figure 1:
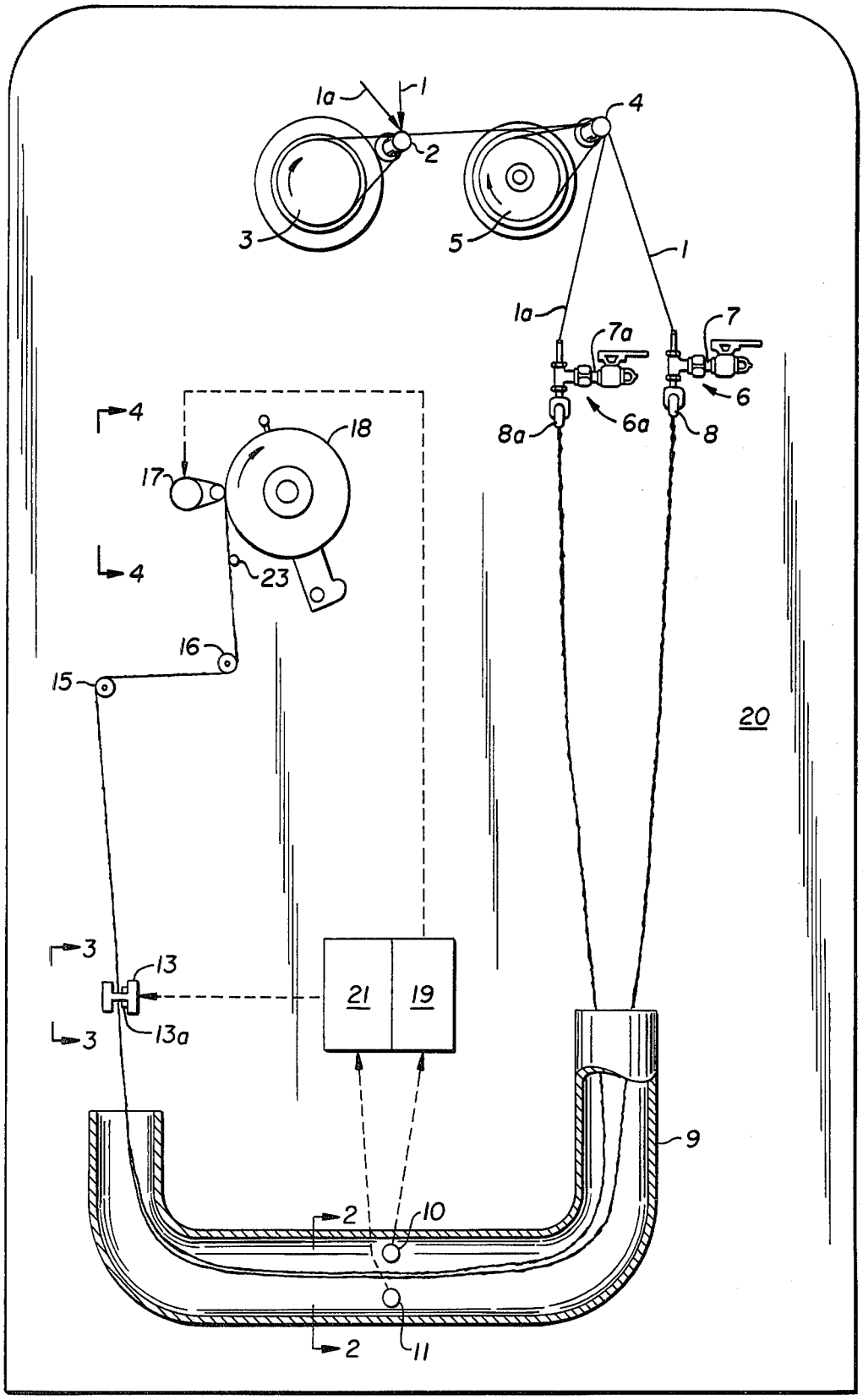
FIG. 1 is a schematic elevation representing a yarn processing system and apparatus for simultaneously processing two yarns and collecting same on the same take-up spindle.

The present invention is generally applicable to thermoplastic yarns and deniers which can be texturized. Such thermoplastic yarns include, for example, nylon yarns, e.g., nylon 66, nylon 6, polyolefin yarns, e.g., polypropylene, combination yarns such as combinations of nylon and polypropylene; and the like. Typically, the drawn yarn fed to the texturizers has a denier in the range of about from 100 to 5000.

The present invention has wide application and can be applied to different types of texturizer systems, for example, fluidized crimping, fluidized bounce crimping and the various forms of stuffer box and false twist crimping. The invention is especially applicable to bounce crimping since the control system also ensures that the yarn free falls from the bounce crimper and is accumulatorless, thus eliminating tangles caused by intermediate yarn accumulation or piling.

The invention is perhaps best explained by reference to the preferred, non-limiting, embodiment schematically illustrated by FIG. 1, which illustrates a combined drawing and texturizer unit.

Thus, referring to FIG. 1 the overall yarn processing apparatus typically comprises a panel board or frame 20 upon which the various operative components of the apparatus, described hereinbelow, are mounted. Undrawn thermoplastic yarns 1 and 1*a* are fed from supply packages of yarn, not shown, to a first driven godet roller 3 with skewed separator roll 2 and then to a second drive godet roller 5 with skewed separator roll 4. Godet rolls 3 and 5 can be and typically are heated. Rolls 4 and 5 advance the yarns at a much greater speed than the rolls 2 and 3, thereby drawing yarns 1 and 1*a*. For example, using nylon 66, rolls 4 and 5 are typically operated at a peripheral speed in the range of about from 3 to 3.6 times that of rolls 2 and 3, thereby effecting about a 3 to 3.6 draw in the nylon 66 yarn. Using nylon 66, godet rolls 3 and 5 are typically operated at temperatures in the range of about from 275° F. to 325° F. Using polypropylene, rolls 4 and 5 are typically operated at peripheral speeds in the range of about 2.7 to 3.1 times that of rolls 2 and 3, thereby effecting about a 2.7 to 3.1 draw in the polypropylene yarn. Using polypropylene, godet rolls 3 and 5 are typically operated at temperatures in the range of about from 222° F. to 275° F. Also, by using overlapping compatible temperatures and draw ratios, different yarn materials can be used (for example, yarn 1 could be polypropylene and yarn 1*a* could be nylon 6).

Also, in place of drawing the yarns in situ, predrawn yarn could be fed directly from supply packages to the texturizing units.

As shown in FIG. 1, yarns 1 and 1*a* are fed from the draw rolls to texturizers 6 and 6*a* typically at speeds in the range of about 3000 to 5000 fpm. The present invention does not alter the operation of the texturizing means and thus the texturizers can be operated in the usual manner. In FIG. 1, the texturizers shown are bounce crimpers.

Continuing from roll 4, yarn 1 advances to bounce crimper 6 and yarn 1*a* advances to bounce crimper 6*a*. A fluid such as steam or heated air is fed to the bounce crimper 6 through line 7 and to bounce crimper 6*a* through line 7*a*. In the bounce crimper, a jet of fluid causes the yarn to be hurled against a screen (not shown) in the interior of the texturizing jet. From there, the yarns rebound out through the respective bounce crimper outlet tubes 8 and 8*a*. The present invention does not alter the operation of the bounce crimper and thus the bounce crimper can be operated in the usual manner. Suitable bounce crimp texturizers and their method of operation are, for example, described in U.S. Pat. Nos. 3,859,696; 3,859,697; 3,879,819 and 3,887,971 which descriptions are hereby incorporated by reference.

Also, although for purposes of illustration, fluidized bounce crimpers have been shown, though it should be appreciated that other types of texturizers could also be used.

It should also be noted that although common draw rolls can be used for yarns 1 and 1*a*, unless, of course, different draw rates are desired, that individual texturizing units must be used. Since, if both yarns are fed to the same texturizer, the yarns will intertwine forming a single combined or conjugate yarn.

Yarn 1 and 1*a* leave bounce crimpers 6 and 6*a* via outlet tubes 8 and 8*a*, respectively, in a substantially tensionless and loosely compacted state, and at this point have a diameter generally approaching or approximating the internal diameter of the outlet tubes 8 and 8*a*, respectively. Yarns 1 and 1*a* leave bounce crimpers 6 and 6*a* at speeds about from 5 to 15% less than the crimper feed speed due to the shortening of the yarn caused by crimping and loop-to-loop compaction, and are wound into yarn packages at speeds generally about 5–10% less than the crimper feed speed due to the retained crimping (but with substantial removal of the loop-to-loop compaction).

Yarns 1 and 1*a* then fall into J-tube 9 which guides the yarns past the respective sensing devices 10, and 11. No yarn accumulation occurs in the J-tube and its use merely represents an adaptation of existing conventional equipment. Other guide means could also be used in place of or in addition to the J-tube (e.g. idler rollers and/or guide plates). Also, the J-tube can be provided with idler rolls to minimize yarn contact with the walls of the J-tube.

Yarns 1 and 1*a* leave the J-tube and pass between tension means 13 and 14, respectively, and then over common idler rolls 15 and 16 to wind up packages 18 and 18*a* (FIG. 4), respectively, on a common winder spindle driven by driving means 17. By adjusting the speed of driving means 17, the rate or speed of yarn take-up can be controlled.

Figure 2:
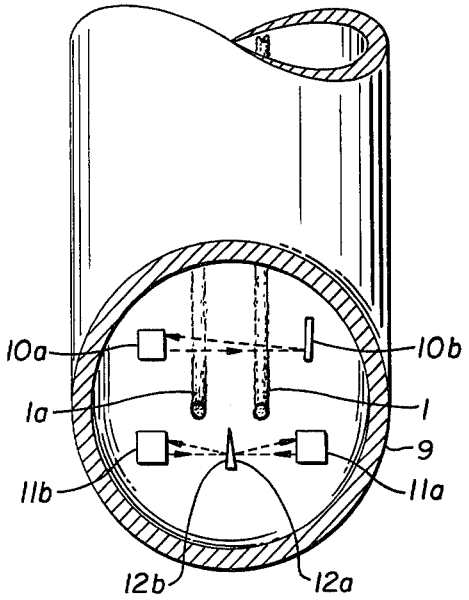
FIG. 2 is a section view of FIG. 1 along line 2—2.

Referring to FIG. 2, the tension sensing means will now be described. Tension sensing means 10 is shown as a combined light source and light receiving means 10*a* and a slightly tilted reflecting surface 10*b* positioned within J-tube 9 in generally diametrically opposed relationship above the base paths of yarns 1 and 1*a* on opposite sides of the predetermined relative upper tension paths of both yarn 1 and yarn 1*a*. (The term "base path" generally refers to the path that the yarns would normally take at an idealized speed about 5 to 15% less than the speed at which the yarns are fed to the texturizers). The term "predetermined relative upper tension path or value" is also a semantic term, thus as used herein, the sensing means is position such that when the predetermined value is just exceeded by the yarn, it will prevent light from being sensed.

If the tension on yarns 1 and/or 1*a* increases, the path of the respective yarn or yarns will rise, eventually blocking the light received by the reflecting surface from the light source and correspondingly cutting off the light received by the light sensing means. The tension sensing means 10 non-selectively senses relative high yarn tension (yarn tightness) of either yarn. When light is not received by the light sensing means, the light sensing means activates controller 19 (FIG. 1) to decrease the rate or speed of yarn take-up of both yarns, for example, by directly reducing the speed of driving roller 18. The speed of the driving roller can be altered by utilizing a conventional D.C. motor and a speed control relay.

As the take-up speed is reduced the tension on yarns 1 and 1*a* will be reduced in turn causing the path of the yarns to be lowered until the light sensing means again receives light and in turn deactivates controller means 19. Upon deactivation the controller increases the yarn take-up speed. Typically, in actual practice there is a cycling effect between the high and low take-up speeds and the steady state is seldom reached.

Referring again to FIG. 2, sensing means 11 comprising a combined light source and receiving means 11*a* and 11*b* and light reflecting means 12*a* and 12*b*, respectively, are positioned below the base paths of yarns 1 and 1*a* to sense the relative low tension value (or slack) on yarns 1 and 1*a*, respectively. The combined light source and light receiving means 11*a* and 11*b* and reflecting means 12*a* and 12*b* are respectively positioned generally diametrically opposed on opposite sides of the predetermined slack paths of yarns 1 and 1*a*. (The term "relative low tension value or slack paths" is again a semantic term, thus, as used herein, the sensing means are positioned such that, when the tension on the respective yarn is reduced just below the predetermined low tension value, light will be blocked from the respective sensing means.

During normal operation, the light sources emit a beam of light which is reflected back by slightly tilted reflecting surfaces 12*a* and 12*b*. As slack on yarns 1 or 1*a* increases, the path(s) of the yarn(s) through J-tube 9 is lowered until eventually the yarn(s) blocks the receipt of light by the light receiving means, selectively activating controller 21 (FIG. 1). For example, when yarn 1 prevents light from being received by light sensing means 11*a*, controller 21 (FIG. 1) is activated in turn selectively activating electromagnetic disc tensioning means 14 (FIGS. 1 and 3) to cause disc 14*a* to be lightly pressed against contact yarn 1*a* with sufficient pressure (drag) to cause sufficient tension to be exerted on yarn 1*a* between the tension means and wind-up means to pull out loop compaction, without pulling out crimp, thereby lengthening yarn 1*a*. The tension means, in effect, acts as a drag and actually exerts very little pressure against yarn 1*a*. Sensing means 11, comprising combined light source means and light receiving means 11*b*, and reflecting means 12*b* is positioned in a like manner with respect to the slack path of yarn 1*a*. Thus, similarly, when yarn 1*a* blocks the receipt of light by the light receiving means, controller 21 is selectively activated and in turn activates disc tension means 13 (FIG. 3) to cause disc 13*a* (FIG. 3) to lightly contact yarn 1 with sufficient pressure (drag) to increase the tension on yarn 1 between the tension means and wind-up means to sufficiently to pull out loop compaction, without removing crimp, thereby increasing the length of yarn 1. If the unit is properly adjusted, both tensioning means cannot be operated at the same time since as soon as light is no longer sensed by the upper tension sensing means, the yarn take-up speed of both yarns is increased, thus raising the path of both yarns before both of the lower tension sensing means can be activated. Thus, one or the other, but not both, of the lower tension sensing means can be activated. Similarly, where more than two yarns are used, one or more but not all of the tension means will be activated.

In actual operation, the steady state is seldom reached and typically there will be a more or less constant cycling of yarn take-up speeds and activation of the respective tensioning means.

Figure 5:
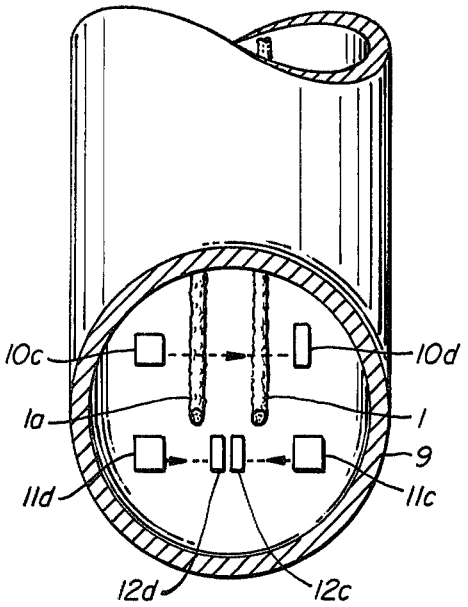
FIG. 5 is a modification of the apparatus shown in FIG. 2 illustrating the use of separate light receiver means.
Figure 7:
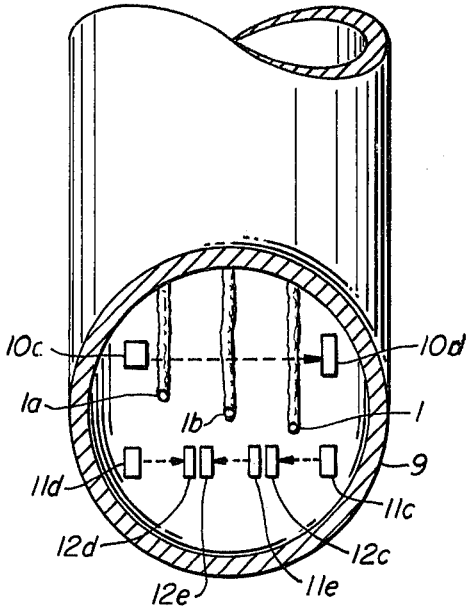
FIG. 7 is a section view of FIG. 6 along line 7—7.

Also, although a light sensing system using reflecting means has been illustrated in both the tension sensing means and the slack sensing means, it should be appreciated that other light sensing or photocell systems could be used (for example, as shown in FIG. 5, replacement of the reflector means with light receiving means 10*d*, 12*c*, 12*d*) as well as other systems for sensing relative yarn tension (e.g. tightness and slack). The remaining items shown in FIG. 7 correspond to and function in the same manner as their counterparts shown in FIG. 2 discussed above.

Figure 3:
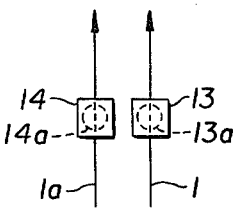
FIG. 3 is a section view of FIG. 1 along line 3—3.

For purposes of clarity, the tension means will be further discussed with respect to FIG. 3. As can be seen from FIGS. 1 and 3, yarns 1 and 1*a*pass through conventional tension means 13 and 14, respectively. When the respective tension means is activated, the disc means (13*a* or 14*a*) gently closes on the yarn thereby exerting fiction on the yarn thus increasing the tension of the yarn between the tension means and the yarn take-up means 18. As before noted, this causes the yarn to lengthen between the winder and yarn take-up means and increases the slack of the yarn between the tension means and texturizer. I have found that particularly good results can be obtained by using conventional electromagnetic tensioning means, though of course other types of tensioning means could also be used.

Figure 4:
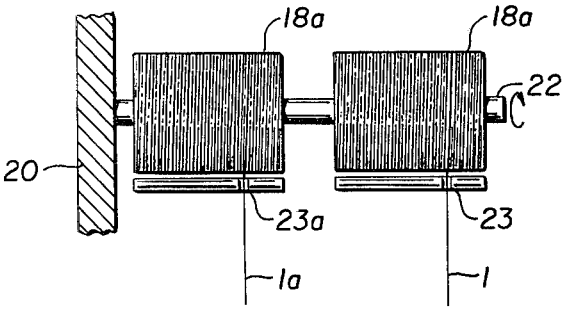
FIG. 4 is a section view of FIG. 1 along line 4—4.

Referring briefly to FIG. 4 (wherein driving roll 17 has been omitted for clarity of presentation), yarns 1 and 1*a* pass to package guides 23 and 23*a*, respectively, and are wound into packages 18 and 18*a* on rotating spindle 22 mounted through panel board 20.

Figure 6:
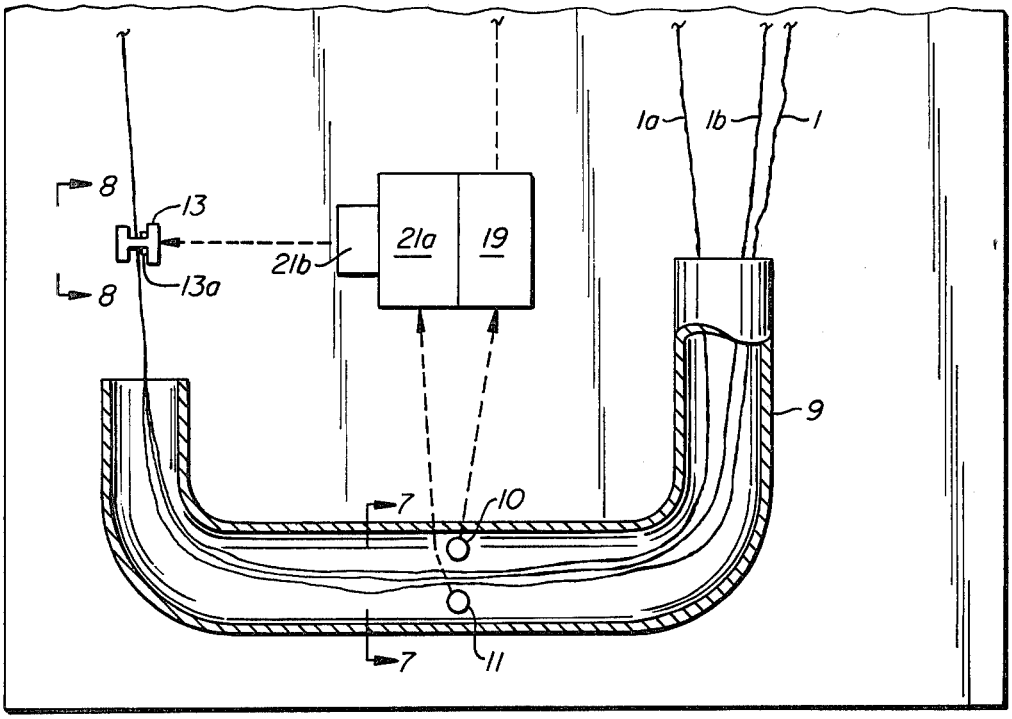
FIG. 6 is a modification of the apparatus shown in FIG. 2 adapted for and illustrating the simultaneous processing of three yarns.
Figure 8:
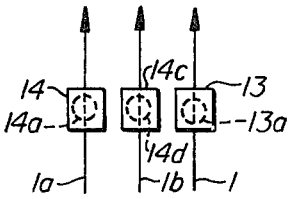
FIG. 8 is a section view of FIG. 6 along line 8—8.

Thus, the present invention provides an apparatus and method for very substantially increasing the rate of yarn production. Also, it should be noted that more than two yarns can be processed at the same time (see FIGS. 6–8) by providing an additional texturizer unit (not shown), low tension slack sensing means (FIGS. 7, 11*e* and 12*e*), and tensioning means (FIGS. 8, 14*c* and 14*d*), per yarn and appropriately adjusting the low tension controller 21*a* or using separate controllers. In this case, the high tension sensing (10*a*–10*b*) and controller 19 activation would remain unchanged and the slack or low tension sensing (FIG. 7, 11*d* and 12*d* and 11*c* and 12*c*) and control system would be modified by an additional sensing means (11*e*–12*e*) and tension means per additional yarn. Thus, in this instance when one of the slack light sensing means (12*c*, 12*d*, or 12*e*) is prevented from sensing source light (11*c*, 11*d*, or 11*e*), then the other tension means for all of the other yarns will be activated. Preferably in this case the control system (FIG. 6) will also be provided with an override mechanism 21*b* wherein when a given yarn prevents light from being received by the appropriate light sensing means the override mechanism 21*b* will also deactivate the tensioning means operating on that yarn. Thus, for example, where three yarns (FIGS. 6–8, 1 1*a* and 1*b*) are being used, when the first yarn blocks light from the appropriate slack sensing means (FIG. 8) the tensioning means for the other two yarns will be activated. However, when the second yarn also blocks light from the appropriate slack sensing means (FIG. 7) it will override the signal to the tensioning means acting on it and deactivate that tensioning means. At the same time it will repeat, but not magnify, the activation signal to the tensioner acting on the third yarn and will transmit a signal to the controller 21*a* to activate the tensioning means acting on the first yarn. However, assuming the first yarn is still blocking light from the light receiving means, this signal will be overridden and the first yarn tensioner will remain deactivated. The upper sensing system 10*c*–10*d* and control 19 and the remaining items shown in FIGS. 6–8 correspond to and operate in the same manner as their counterparts in FIGS. 1–3 already discussed hereinabove.

Obviously, many modifications and variations of the invention, described hereinabove and below in the claims, can be made without departing from the essence and scope thereof.

What is claimed is:

1. A process for texturizing thermoplastic yarns which comprises the steps of:

(a) simultaneously texturizing at least two drawn yarns in distinct texturizer means;

(b) collecting all of the texturized yarn by winding said yarns on the same winder spindle;

(c) sensing the relative tension on each texturized yarn at a position between said texturizer means and said winder spindle and reducing the rate of yarn wind-up when the sensed tension on any yarn exceeds a predetermined relative high tension value and increasing the rate of yarn wind-up speed when the sensed tension on all the yarns is not greater than said predetermined value; and (d) when the sensed tension on at least one of said yarns decreases below a predetermined low tension value selectively applying sufficient tension on every yarn, whose sensed relative tension is at least equal to said predetermined low tension value, at a location between said sensing means and said winder spindle, sufficient to cause loop-to-loop yarn compaction to be pulled therefrom, without removing yarn crimp, thereby lengthening that yarn, whereby approximately equal lengths of said yarns are wound on said winder spindle.

2. The process of claim 1 wherein said winder spindle is laterally offset relative to said texturizer means whereby the path of said each texturized yarn from said texturizer means to said winder spindle has a lateral component.

3. The process of claim 2 wherein the relative vertical height of the lateral component of said yarn paths raises and lowers as yarn tension increases and decreases and wherein said sensed yarn tension is sensed by sensing said relative vertical height of said yarns.

4. The process of claim 3 wherein said yarn tension is sensed relative to said predetermined relative high tension value by projecting, and sensing, a beam of light across but above the base paths of said yarns at a vertical height such that when the tension on at least one of said yarns exceeds said predetermined value, said light will be prevented from being sensed.

5. The process of claim 3 wherein said yarns are wound in separate packages on said winder spindle.

6. The process of claim 3 wherein two thermoplastic yarns are used.

7. The process of claims 3 or 6 wherein said texturized yarn is fluidized bounce crimp texturized.

8. The process of claim 2 wherein said yarn tension is selectively sensed relative to said predetermined relative low tension value by individually projecting, and sensing, beams of light respectively across but below the base paths of said yarns at a vertical height such that when tension on any yarn is below said predetermined relative low tension level such yarn will prevent its respective beam of light from being sensed.

9. The process of claims 1 or 8 wherein two thermoplastic yarns are used.

10. The process of claims 1 or 8 wherein said yarns are wound in separate packages on said winder spindle.

11. The process of claims 1 or 8 wherein said texturized yarn is fluidized bounce crimp texturized.

* * * * *